US006557281B1

(12) United States Patent
Lewiner et al.

(10) Patent No.: US 6,557,281 B1
(45) Date of Patent: May 6, 2003

(54) PUBLIC DISPLAY DEVICE

(76) Inventors: Jacques Lewiner, 7, avenue de Suresnes, 92210 Saint-Cloud (FR); Eric Carreel, 9, rue du Général Gouraud, 92190 Meudon (FR)

( * ) Notice: Subject to any disclaimer, the term of this patent is extended or adjusted under 35 U.S.C. 154(b) by 0 days.

(21) Appl. No.: 09/555,396

(22) PCT Filed: Nov. 24, 1998

(86) PCT No.: PCT/FR98/02508

§ 371 (c)(1),
(2), (4) Date: Jul. 24, 2000

(87) PCT Pub. No.: WO99/28891

PCT Pub. Date: Jun. 10, 1999

(30) Foreign Application Priority Data

Nov. 27, 1997 (FR) ..... 97 14923

(51) Int. Cl.[7] ..... G09F 19/06; G09F 11/29
(52) U.S. Cl. ..... 40/471
(58) Field of Search ..... 40/471

(56) References Cited

U.S. PATENT DOCUMENTS 6,252,575 B1 * 6/2001 Kern ..... 40/471

FOREIGN PATENT DOCUMENTS

| | | | | |
|---|---|---|---|---|
| DE | 199 46 952 | * | 4/2001 | ..... G09F/15/02 |
| FR | 2 598 539 | | 11/1987 | |
| FR | 2 629 243 | | 9/1989 | |
| JP | 7-52497 | * | 7/1995 | ..... G09F/11/29 |
| JP | 7-56519 | * | 7/1995 | ..... G09F/11/29 |

* cited by examiner

*Primary Examiner*—Cassandra H. Davis
(74) *Attorney, Agent, or Firm*—Marshall, Gerstein & Borun

(57) ABSTRACT

A public display panel includes an external casing which has at least one transparent opening, a support band made of flexible material which carries juxtaposed posters, and a driving mechanism for selectively displaying posters opposite the transparent opening. This display panel further includes an electronic interface adapted to receive data representing new posters to be printed on the support band, an electronic central unit communicating with the interface, and a printer controlled by this central unit for printing new posters on the support board.

10 Claims, 2 Drawing Sheets

FIG.1.
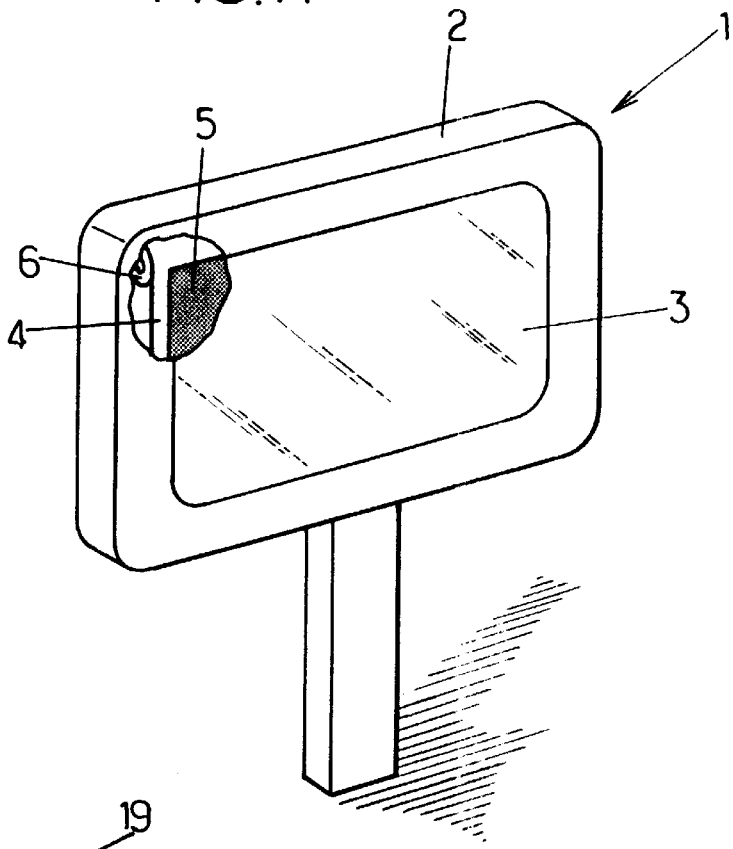
FIG.5.
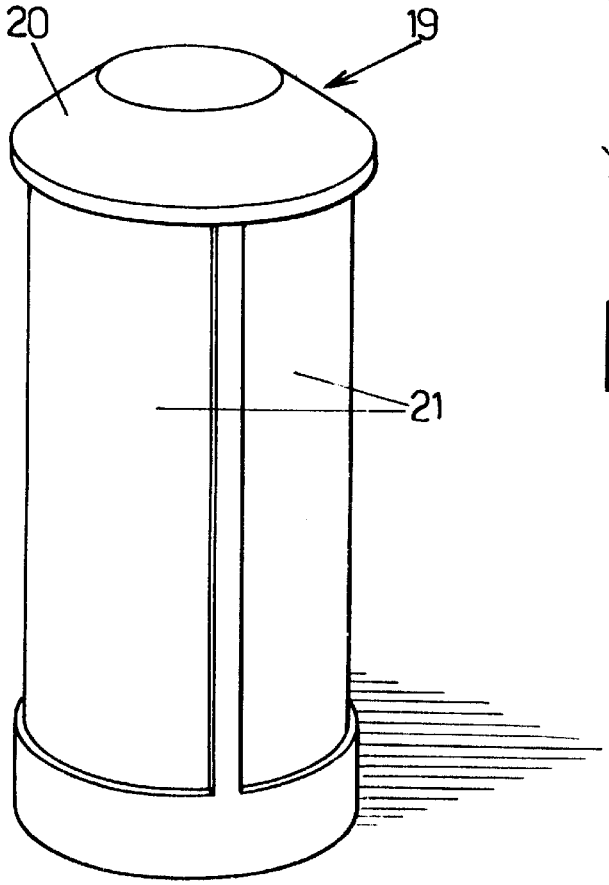
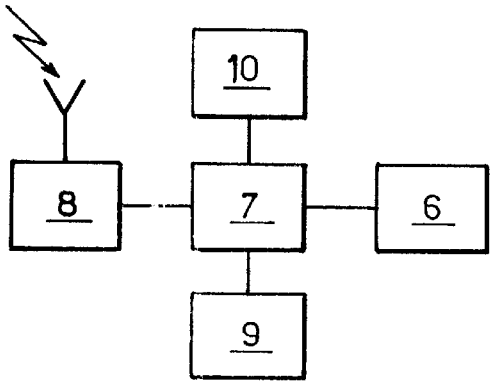
FIG.2.

PUBLIC DISPLAY DEVICE

FIELD OF THE INVENTION

The present invention relates to public display devices.

More particularly, the invention concerns a public display device comprising:

- a closed external casing which defines a certain internal volume and which has at least one transparent opening,
- a support band made of flexible material which is arranged in the casing internal volume, this band having at least one so-called printing side, adapted to be printed so as to comprise several juxtaposed posters along the support band,
- a support band driving mechanism, this mechanism being adapted to selectively display, opposite the transparent opening, one of the printed posters on the support band.
- at least one electronic interface adapted to receive digital data representing designs to be printed on the support band,
- an electronic central unit communicating with the interface and controlling the support band driving mechanism,
- and a printer controlled by the central unit, this printer being arranged opposite a printing zone belonging to the support band printing side, the central unit being adapted to make the printer print the designs received by the interface.

BACKGROUND OF THE INVENTION

Document FR-A-2 598 539 describes an example of such a display device, wherein the printer is a two channel plotter arranged in correspondence with the external casing's transparent opening, so that each poster is printed in front of the public.

This known display device has the disadvantage of not being able to display a complete poster to the public, whilst a new poster is being printed.

This disadvantage is all the more important because the printing time of a poster is long.

The same disadvantage exists in the display device disclosed in the document FR-A-2 629 243, which describes a similar display device: this other known device comprises two transparent openings for displaying posters, but the printing of a poster neutralizes at least one of these transparent openings for a period of about 30 minutes.

OBJECTS AND SUMMARY OF THE INVENTION

The object of the present invention is to overcome this disadvantage.

To this end, according to the invention, the printing zone is arranged so as not to be visible through the external casing's transparent opening, the display device comprising moreover:

- a buffer zone enabling a variable length of support band to be accumulated between the printing zone and the part of the support band which corresponds to the poster displayed opposite the casing's transparent opening, this buffer zone being adapted to enable several posters to be printed in advance while holding fixed the poster displayed opposite the casing's transparent opening,

- and means to hold taut at least said part of the support band arranged opposite the casing's transparent opening when a certain length of support band is accumulated in the buffer zone.

By means of these arrangements, the printing of one or several new posters can be made while continuing to display to the public one of the previously printed posters, and this even when the printer comprises a printing head only moveable perpendicularly to the direction of movement of the band (in this latter case, the printing of a new poster necessitates the band to be moved at the same time as the printing head is moved, but this movement of the band does not prevent continuing to display the same poster in the casing's transparent opening, due to the fact that a variable band length can be accumulated in the buffer zone).

In preferred versions of the invention, one and/or other of the following arrangements can possibly be resorted to:

- the electronic interface is a telecommunication interface,
- the electronic interface is a data medium reader chosen from among optical disc readers, magnetic tape readers, magnetic disc drives, magnetic hard disc drives or semi-conductor memories,
- the support band has information zones carrying codes representing data chosen from among identification data of the posters and location data of the posters, the display device comprising moreover at least one reader device which is arranged in correspondence with said information zones and which is adapted to read the printed data in these zones, this reader device being connected to the electronic central unit,
- the printer comprises a printing head able to be moved in translation along two perpendicular axes, namely a first axis arranged parallel to the length of the support band, and a second axis arranged along the width of the support band,
- the printer comprises a printing head only moveable parallel to the width of the support band, the driving mechanism being adapted to move the support band parallel to its length in front of the printing head during the printing operation,
- the electronic central unit has in its memory at least one character font,
- the external casing has a flat shape, having two parallel principal sides, at least one of which comprises said transparent opening,
- the external casing has a cylindrical shape and has an annular lateral wall wherein is made said at least one transparent opening,
- the electronic interface is also adapted to receive, besides data representing designs to be displayed, chronological data relating to the urgency and/or to the frequency and/or the duration of display of said designs, the electronic central unit being adapted to memorize these data, and to print and display opposite the casing's transparent opening the corresponding posters, as a function of said chronological data.

BRIEF DESCRIPTION OF THE DRAWINGS

Other characteristics and advantages of the invention will emerge during the following detailed description of several of its versions, given as non-restrictive examples, with reference to the appended drawings.

In the drawings:

FIG. 1 is a perspective diagrammatic view of a public display device according to a first version of the invention, FIG. 2 is a block diagram of the display device of FIG. 1, FIG. 5 is perspective diagrammatic view of a display device according to a second version of the invention.

MORE DETAILED DESCRIPTION

Figure 3:
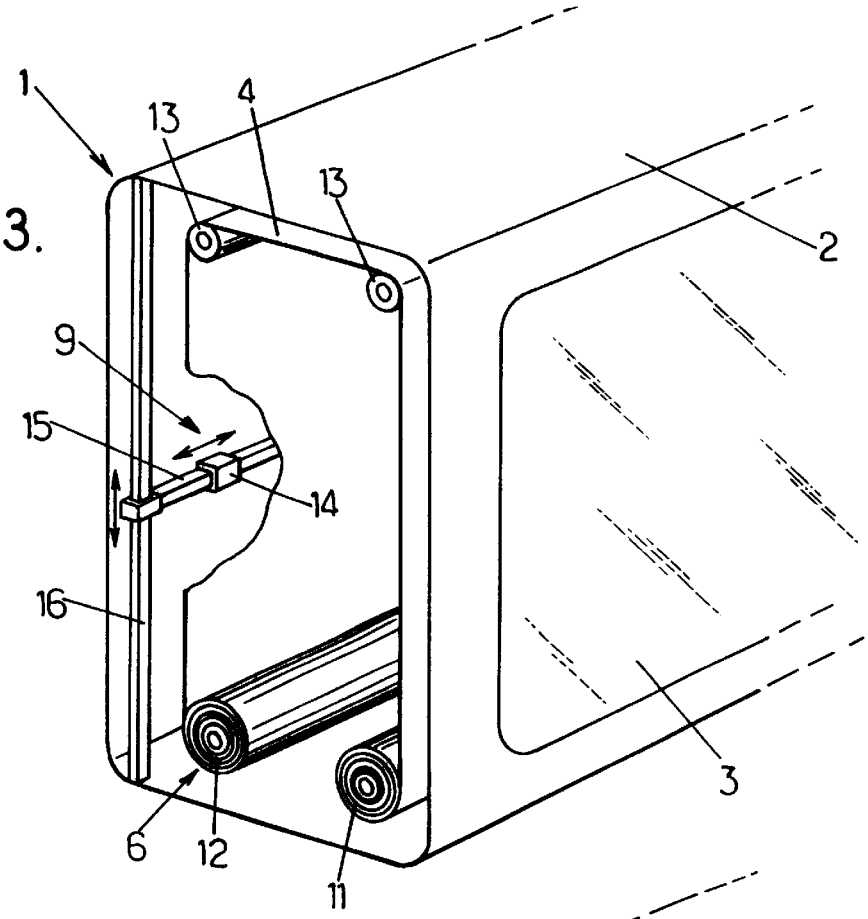
FIG. 3 shows diagrammatically the driving device and the printer located inside the display device of FIG. 1.

In the different figures, the same references designate identical or similar elements.

FIG. 1 shows a public display device which appears in the shape of a panel 1.

This panel comprises a closed external casing 2, having two parallel principal sides, at least one of which is provided with a glazed opening 3.

The casing 2 delimits a certain internal volume, which contains a support band 4 made of a flexible material (paper, or transparent synthetic film), this band having at least one so-called printing side, adapted to be printed so as to display several posters 5 (advertising or containing general information) juxtaposed along said band, each of these posters having dimensions close to those of the glazed window 3.

The support band 4 can be moved parallel to its length by a driving mechanism 6 which is adapted to selectively display, opposite the glazed window 3, one or other of the posters 5 printed on the support band.

As shown in FIG. 2, the display panel 1 comprises moreover an electronic central unit 7 which includes a memory (containing, in particular, character fonts) and which controls the driving mechanism 6.

This central unit is also connected to a radio receiver 8 or to any other electronic interface enabling data in digital form to be received: telecommunication interface, data medium reader such as: magnetic tape reader, magnetic disk drive, magnetic hard disk drive, optical disc reader, etc.

Furthermore, the display panel 1 comprises moreover, in its internal volume, a printer 9 controlled by the central unit 7, this printer being arranged opposite a printing zone belonging to the printing side of the support band, and the central unit 7 being adapted to make the printer 9 print designs (images, alphanumeric characters, etc) received by means of the radio receiver 8, this reception and this printing being able to be carried out for example at night.

Furthermore, the radio receiver 8 can if the need arises also receive posters' identification data, besides data relative to the designs contained in these posters: in this case, the central unit 7 is also adapted to make the printer 9 print, on the support band 4, codes representing said identification data, with in addition if the need arises location data of the posters.

This identification and/or location data are preferably printed in so-called information zones of the support band 4, outside the zones of the printing side of this band which form posters 5.

Furthermore, the display panel then also comprises at least one reader 10 adapted to read the printed codes in the information zones, this reader 10 being able to be for example a bar code reader.

As shown in FIG. 3, the driving device 6 can comprise:

a horizontal roller 11 on which are wound the parts of the support band 4 which carry already printed posters, a horizontal roller 12 for the unprinted support band, and one or more horizontal return rollers 13, which in this case have fixed axes of rotation.

In this case, the printer 9 can comprise a printing head 14, for example an ink jet, movable in translation along a guide bar 15 parallel to the width of the support band 4, this guide bar 15 itself being moveable in translation parallel to the length of the band 4 along guide rails 16.

Figure 4:
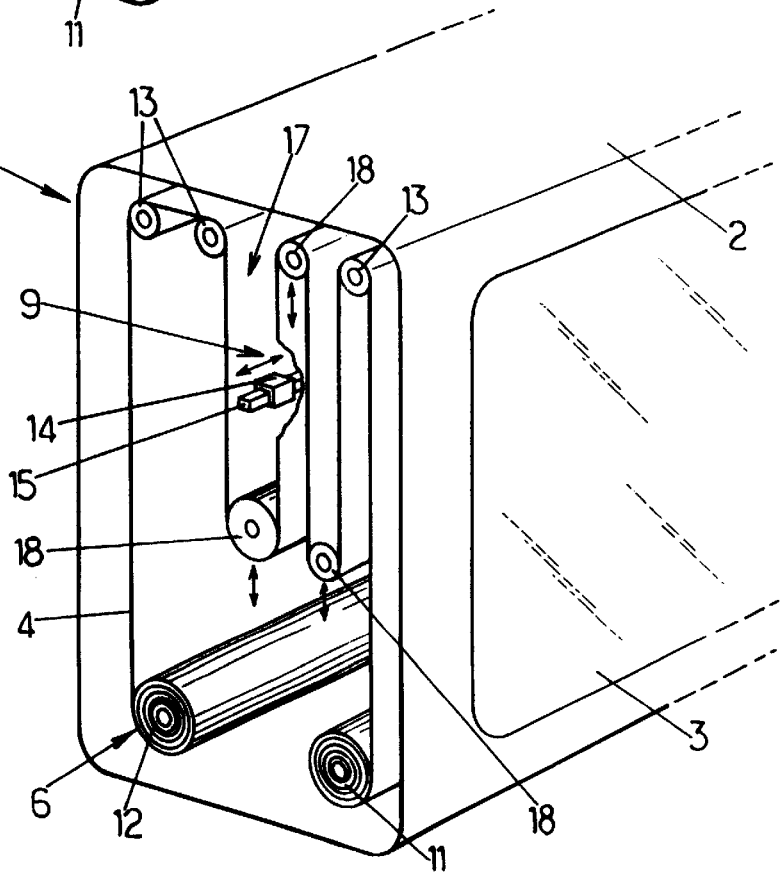
FIG. 4 shows diagrammatically a variant of the driving mechanism and the printer shown in FIG. 3.

Furthermore, as shown in FIG. 4, it is advantageous that the driving mechanism 6 comprises a buffer zone 17 wherein a certain length of the support band between the printing zone and the part of the support band which corresponds to the poster displayed opposite the transparent window 3 can be accumulated.

In this way several posters 5 can be printed in advance by means of the printer 9, while continuing to display the same poster in the window 3.

In order that the poster displayed in the window 3 retains a good appearance, it is then desirable that the driving device 6 comprises means for holding taut the part of the support band arranged opposite the window 3, when a certain length of band is accumulated in the buffer zone 17.

In the particular example shown in FIG. 4, these tensioning means are constituted by moveable return rollers 18 which can be moved vertically and which are controlled so as to exert a constant force on the support band 4, and the support band moves during printing.

Furthermore, as shown in FIG. 4, when the driving mechanism comprises a buffer zone 17, the guide bar 15 of the printing head 14 of the printer can be fixed, in which case said printing head is moveable only parallel to the width of the support band 4.

The device which has just been described enables the posters already printed on the support band 4 to be easily modified, for example in order to include on them additional messages, or to print new posters, without human intervention on the display panel 1.

To advantage, the data received by means of the radio receiver 8 can include chronological data relating to the display urgency and/or frequency and/or duration of each poster.

In particular, it is in this way possible to send to the display panel 1 urgent general information, which will be printed in a priority way and immediately displayed in the transparent window 3, for example in order to warn the population of a town of a danger, of pollution or other things.

Of course, the invention is not limited to one particular shape of public display device. In particular, as shown in FIG. 5, the display device can appear in the shape of a "Morris column" type of column 19, in which case the casing 20 of this display device has a cylindrical shape, just as the transparent window(s) of this casing, and the rollers of the driving mechanism, which can be similar to those of FIGS. 3 and 4, are generally arranged with their axes of rotation vertical.

What is claimed is:

1. A public display device, comprising:

a closed external casing which defines a certain internal volume and which has at least one transparent opening, a support band made of flexible material which is arranged in the internal volume of the casing, this band having at least one so-called printing side, adapted to be printed in a way to comprise several posters juxtaposed along the support band, a driving mechanism of the support band, this mechanism being adapted to selectively display, opposite the transparent opening, one of the posters printed on the support band, at least one electronic interface adapted to receive digital data representing designs to be printed on the support band, an electronic central unit communicating with the interface and controlling the driving mechanism of the support band, and a printer controlled by the central unit, this printer being arranged opposite a printing zone belonging to the printing side of the support band, the central unit being adapted to make the printer print the designs received by the interface, wherein the printing zone is arranged so as not to be visible through the transparent opening of the external casing, the display device comprising moreover:

a buffer zone enabling a variable length of support band to be accumulated between the printing zone and the part of the support band which corresponds to the poster displayed opposite the casing's transparent opening, this buffer zone being adapted to enable several posters to be printed in advance whilst holding fixed the poster displayed opposite the casing's transparent opening, and means for holding taut at least said part of the support band arranged opposite the casing's transparent opening when a certain length of support band has accumulated in the buffer zone.

2. A display device according to claim 1, wherein the electronic interface is a telecommunication interface.

3. A display device according to claim 1, wherein the electronic interface is a data medium reader chosen from among optical disc readers, magnetic tape readers, magnetic disk drives, and magnetic hard disk drives.

4. A display device according to claim 1, wherein the support band has information zones carrying codes representing data chosen from among identification data of posters and position data of the posters, the display device comprising furthermore at least one reader device which is arranged in correspondence with said information zones and which is adapted to read the data printed in these zones, this reader device being connected to the electronic central unit.

5. A display device according to claim 1, wherein the printer comprises a printing head moveable in translation along two perpendicular axes, namely a first axis arranged parallel to the length of the support band, and a second axis arranged along the width of the support band.

6. A display device according to claim 1, wherein the printer comprises a printing head only moveable parallel to the width of the support band, the driving mechanism being adapted to move the support band parallel to its length in front of the printing head during the operation of the printer.

7. A display device according to claim 1, wherein the electronic central unit has in memory at least one character font.

8. A display device according to claim 1, wherein the external casing has a flat shape, having two parallel principal sides, at least one of which comprises said transparent opening.

9. A display device according to claim 1, wherein the external casing has a cylindrical shape and has an annular lateral wall wherein is made said at least one transparent opening.

10. A display device according to claim 1, wherein the electronic interface is also adapted to receive, besides data representing the design to be displayed, chronological data relative to the urgency and/or the frequency and/or the display duration of said designs, the electronic central unit being adapted to memorize these data, and to print and display opposite the casing's transparent opening the corresponding posters, as a function of said chronological data.

* * * * *